US005078183A

United States Patent [19]

Broughton

[11] Patent Number: 5,078,183

[45] Date of Patent: Jan. 7, 1992

[54] FLEXIBLE LENO HEDDLE SYSTEM

[76] Inventor: Eve T. Broughton, 1564 Vista St., Oakland, Calif. 94602

[21] Appl. No.: 604,192

[22] Filed: Oct. 29, 1990

[51] Int. Cl.[5] ..... D03C 7/00

[52] U.S. Cl. ..... 139/52; 139/50; 139/93

[58] Field of Search ..... 139/91, 52, 50, 51, 139/53, 93–96

[56] References Cited

U.S. PATENT DOCUMENTS

| | | | |
|---|---|---|---|
| 1,637,796 | 8/1927 | Andrews | 139/91 |
| 1,667,637 | 4/1928 | Pennoyer | 139/91 |
| 1,764,917 | 6/1930 | Wall | 139/91 |

*Primary Examiner*—Andrew M. Falik

[57] ABSTRACT

A loom-controlled leno or cross-weaving system, alone or in conjunction with tabby or ordinary weaving. The leno heddle is composed of two upright members, each connected to two flexible cross-members. Each upright member is connected to a separate, independently moving portion of the loom frame. Each cross-member has an eye in the middle for the passage of the warp thread. The upper cross-member is positioned below the lower cross-member when the warp threads pass through the eyes. Alternation of the elevation of the upright members causes the warp threads to alternate positions laterally. Leno weaving is achieved with a throw of weft for every alternation of upright member position. Tabby weaving is done using a rising loop and a falling loop, each connected to the loom frame independently. One warp thread goes through the eye of the upper cross-member and also through the rising loop. The other warp thread passes through the eye of the lower cross-member and the falling loop. When the loops are separated, the tabby weft is thrown.

7 Claims, 5 Drawing Sheets

FLEXIBLE LENO HEDDLE SYSTEM

BACKGROUND

Weaving is well-known. In typical loom systems, warp threads are suspended between the front and back of the loom under tension. Each thread goes through the eye of a heddle which is attached to the loom. The loom has mechanisms to raise or lower these heddles and thereby raise or lower the warp threads passing through the heddles. The opening thus created between the raised and lowered warp threads is the shed, and it is through the shed that the weft is passed.

In ordinary weaving, a warp thread can only move in two positions, up and down, but it maintains the same lateral relationship with its neighboring warp threads.

In doup leno weaving, one thread of a pair of warp threads can be made to jump over the other and back again, creating the two leno positions. These are: (a) the first thread below and to the right of the second, and (b) the first thread below and to the left of the second. However, ordinary weaving in a doup system can be achieved easily in one position only because the crossing of the warp threads between the heddles interferes with a good shed opening.

In doup systems and many conventional leno weaving systems, such as those disclosed in U.S. Pat. Nos. 2528, 946,137, and 1,067,538, loops, heddles or members of the warp pair interfere to some degree with the movement of the warp threads, causing added friction and tension which can lead to fraying or breakage of warp threads.

Other doup and conventional leno systems, such as those disclosed in U.S. Pat. Nos. 2528, 745,240, 946,137, 1,067,538, and 2,845,094, use a "ground" or "stationary" warp and a "jumper" or "leno" warp. The two warps are under uneven tension when the shed is opened and they are consumed differently, which necessitates the use of extra tensioning devices and/or a second warp beam.

Rigid-bar heddle systems, such as that disclosed in U.S. Pat. No. 1,067,538, need a large space in which to function. The loom shafts which support the heddles cannot be set closely together, thus it is difficult to adapt these heddles for use in ordinary looms.

The purpose of this invention is to create a loom-controlled means of causing a pair of warp threads to twist, that is, to cross over each other, to maintain this position while the weft is thrown, to revert to the original position for another throw of weft, and to do all this without physicial obstruction by one warp thread upon the other of by any portion of the loom or heddles upon either warp thread.

The purpose of this invention is also to create a loom-controlled means of ordinary weaving, where the weft may be placed either under or over a particular warp thread, with the warp threads in either crossed or uncrossed positions, and which can be used at any time in place of cross-weaving.

This heddle system is simple in design and in construction, and can be adapted for use on looms heretofore used only for ordinary weaving, in place of regular small-eyed or long-eyed heddles. No other special equipment is necessary.

SUMMARY OF THE INVENTION

This invention consists of two parts: a leno heddle to allow cross-weaving, and a set of tabby loops to allow tabby (ordinary) weaving. The leno heddle is comprised of two uprights connected by two rungs, each rung with an eye in the middle, through which runs the warp thread. Each upright operates independently of the other. The tabby system is comprised of rising and hanging loops. The tabby system operates independently of the leno system, and in such a way that the hanging and rising loops either approximate or separate. Of a pair of warp threads, one will go through the hanging tabby loop and through the eye of the lower rung which has been pulled up above the upper rung. The other thread goes through the rising tabby loop and then through the eye of the upper rung which has been pulled down below the lower rung.

DETAILED DESCRIPTION OF THE INVENTION

Figure 1:
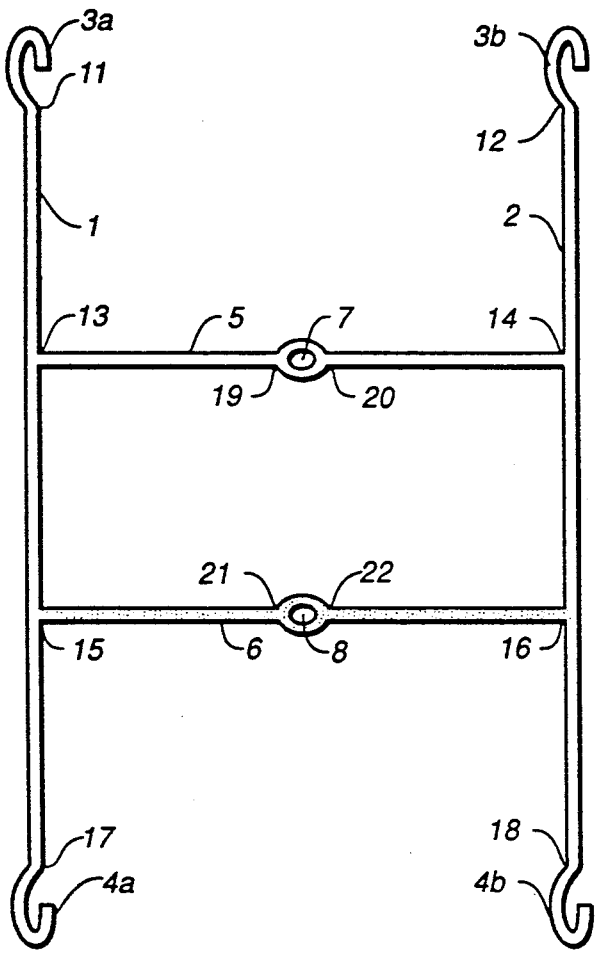
FIG. 1 shows the component parts of the leno heddle.

In FIG. 1, the leno heddle is pictured in an open and non-working position. The uprights 1 and 2 may be of rigid or flexible material. The left upright 1 is attached to the loom, (not shown) at upper attachment 3*a* and lower attachment 4*a*. Likewise, the right upright 2 is attached to the loom by upper attachment 3*b* and lower attachment 4*b*. Note that both the upper and lower attachments are not necessary if the uprights are rigid. The left upright 1 and right upright 2 are connected together by upper rung 5 at the points 13 and 14 and by lower rung 6 at points 15 and 16. The upper rung 5 has a left portion 5*a* and right portion 5*b* connected by eye 7 at points 19 and 20. The lower rung 6 has a left portion 6*a* and a right portion 6*b* connected by eye 8 at points 21 and 22. The rungs 5 and 6 are referably of flexible material, be it fiber, coil, linked, or expandable. The eyes 7 and 8 for the warp can vary in size, and may be of flexible or rigid material.

In FIGS. 2 through 7, the warp thread 23 inserts through the eye 8 and the descending tabby loop 9 and the warp thread 24 inserts through eye 7 and the ascending tabby loop 10. The tabby loops 9 and 10 may be of flexible or rigid material, but must be sufficiently long to allow the free movement of the warp threads 23 and 24 during leno weaving.

Figure 2:
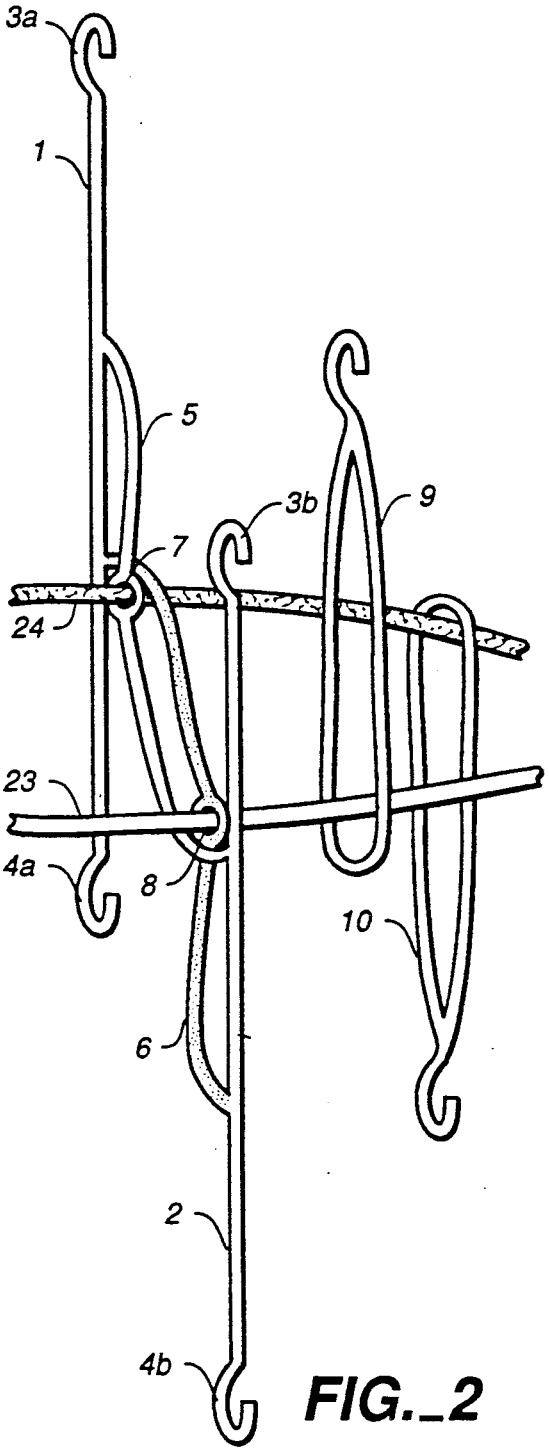
FIG. 2 is an oblique view of the leno heddle system of the present invention in operation in the first leno position.
Figure 3:
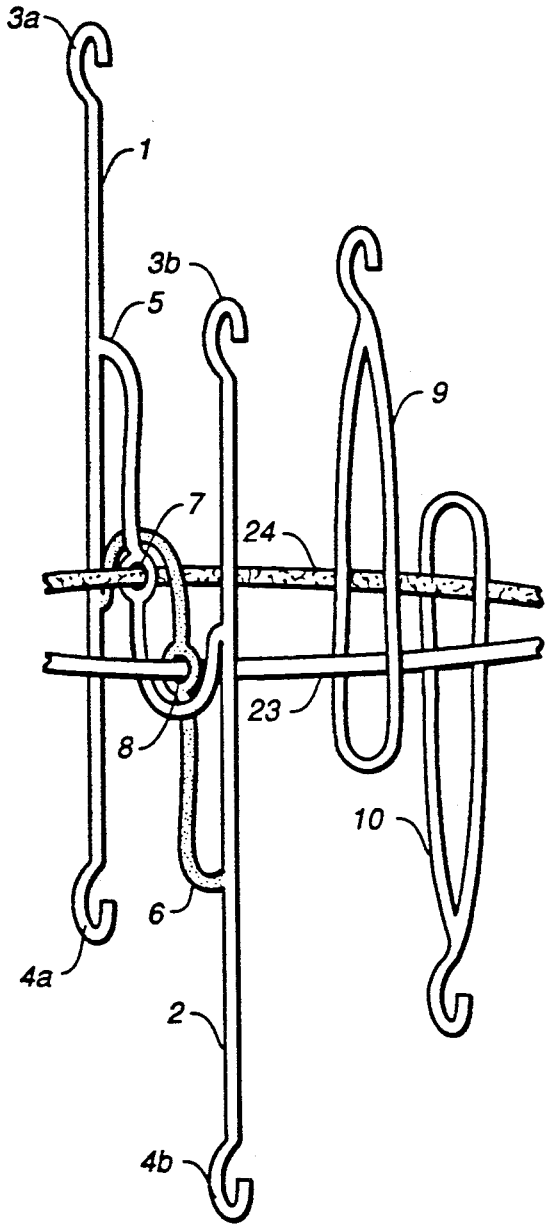
FIG. 3 is an oblique view of the leno heddle system of the present invention in a transitional or semi-relaxed tension position.
Figure 4:
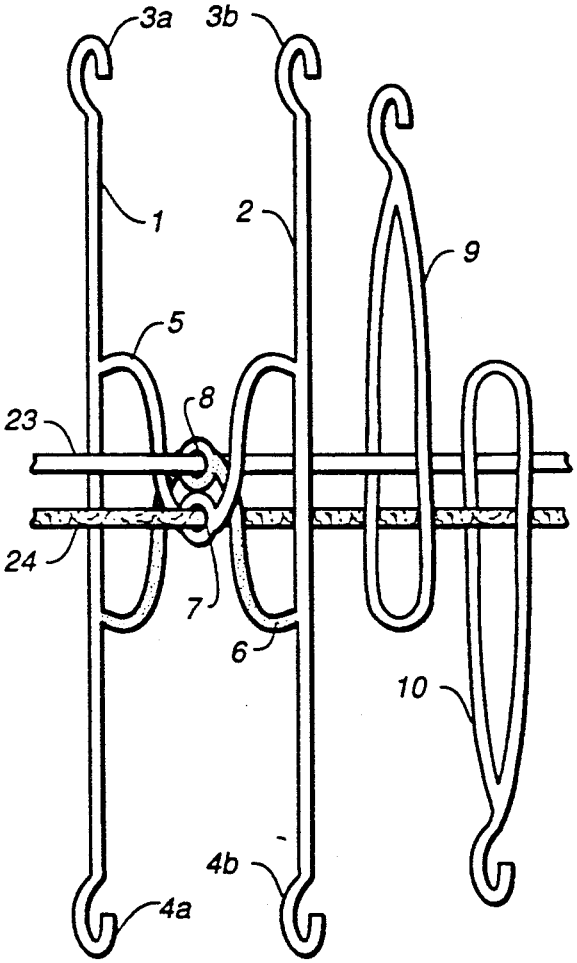
FIG. 4 is an oblique view of the leno heddle system of the present invention in operation in the relaxed or resting warp line position.

In FIG. 2, the right upright 2 has been lowered and the left upright 1 raised. Warp thread 23 is down and to the right of warp thread 24. This is the first leno position. With relaxation of tension (FIG. 3), the shed closes and warp threads 23 and 24 revert to the resting warp line (FIG. 4).

Figure 5:
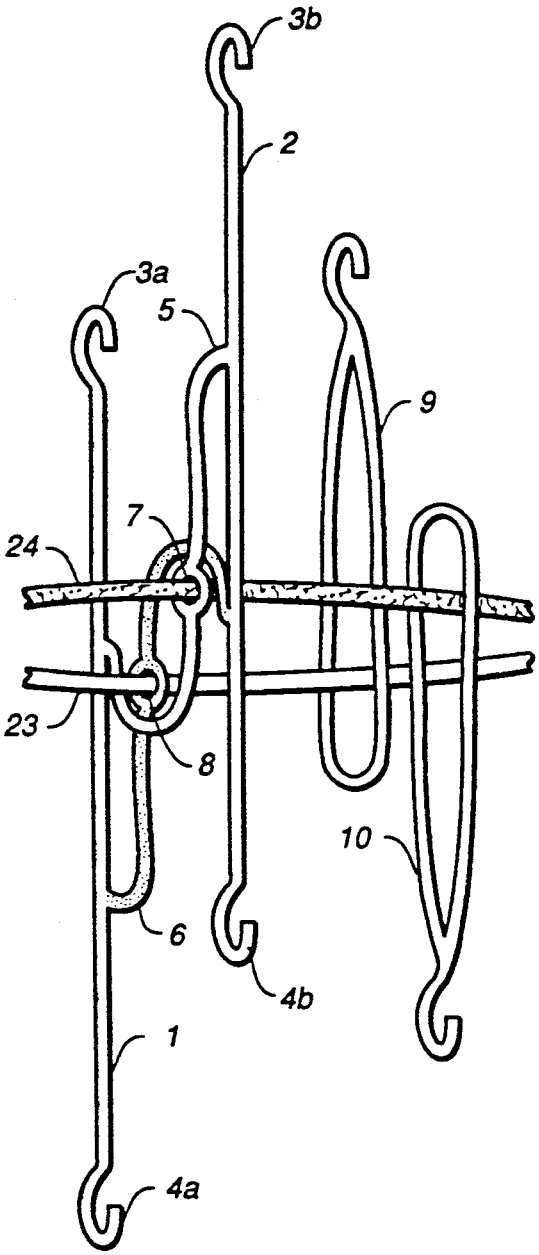
FIG. 5 is an oblique view of the leno heddle system of the present invention in a transitional or semi-relaxed tension position.
Figure 6:
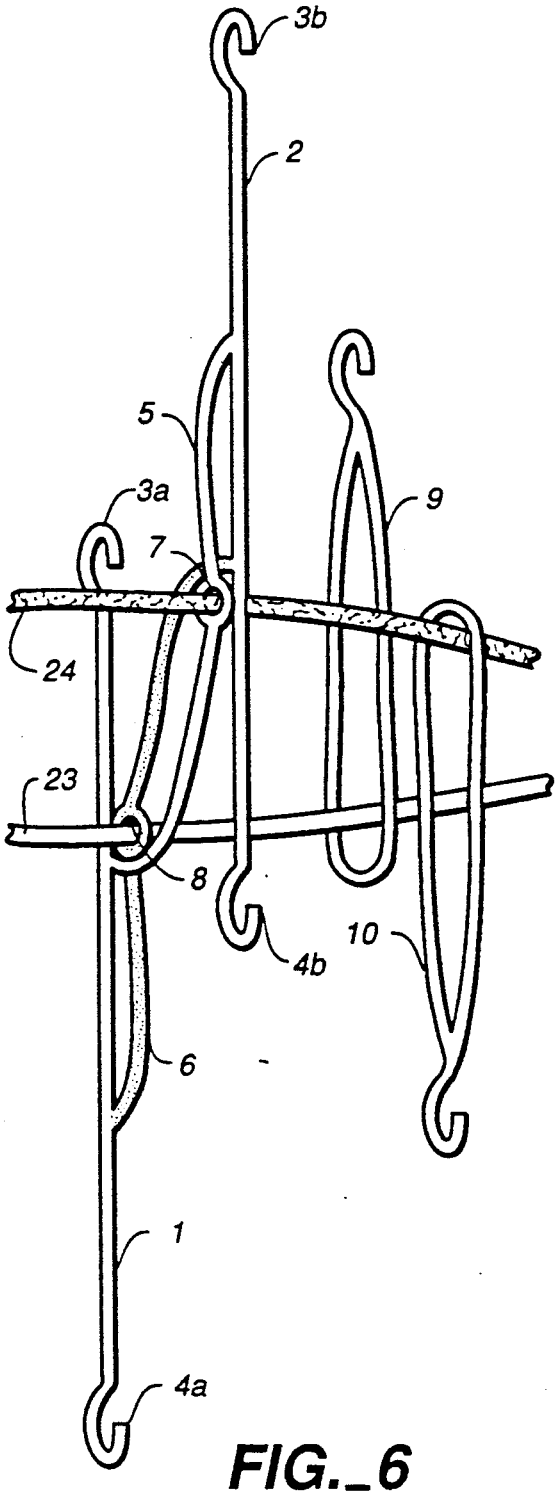
FIG. 6 is an oblique view of the leno heddle system of the present invention in operation in the second leno poisition.

In FIG. 5 only the right upright 2 has been raised while FIG. 6 shows the combination of the left upright 1 lowered and the right upright 2 raised, and now warp thread 23 is down and to the left of warp thread 24. FIG. 6 is the second leno position.

Figure 8:
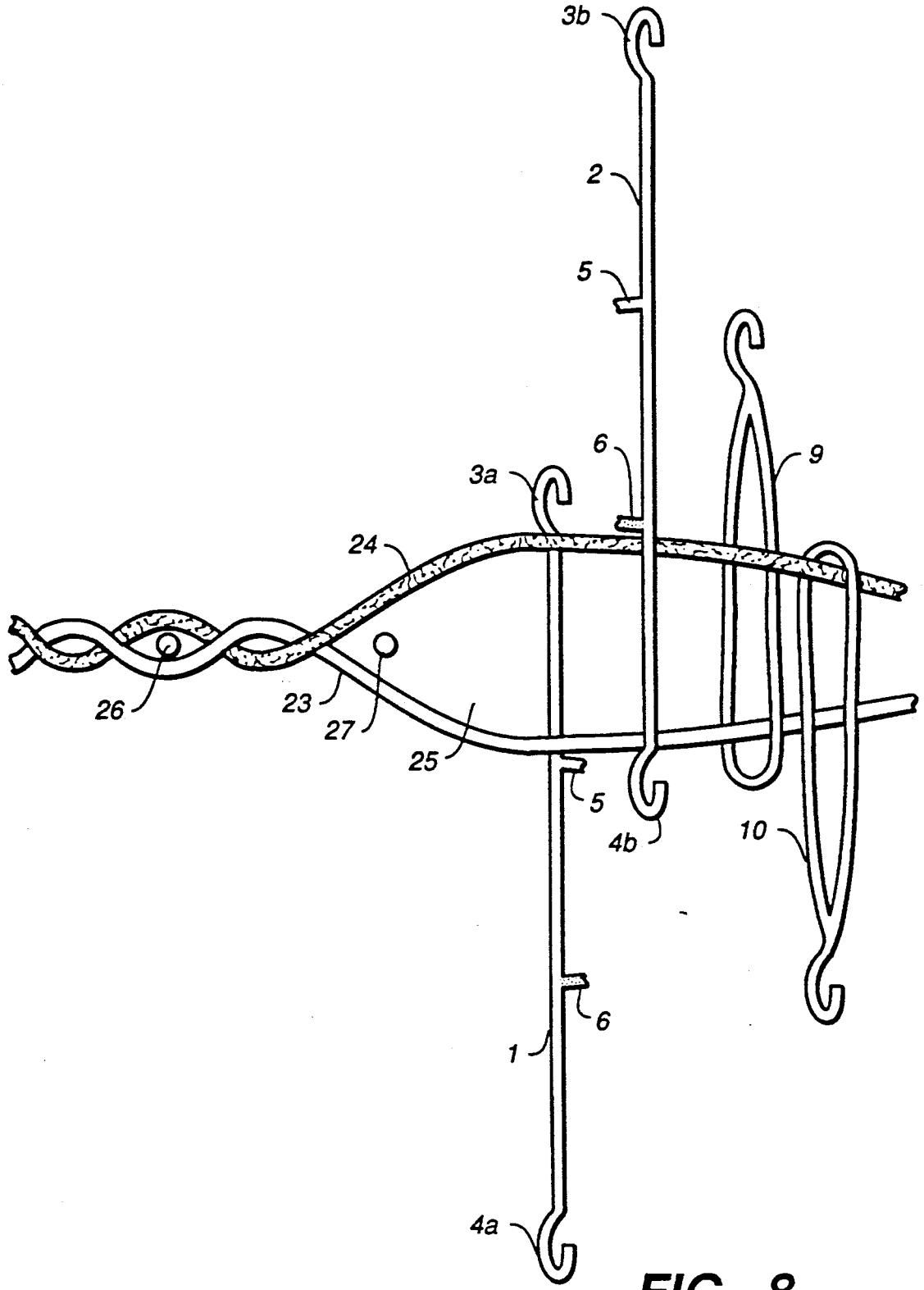
FIG. 8 is a fragmental side view of the leno heddle, showing the placement of the warp threads and weft threads during cross weaving.

In FIG. 8, upright member 2 has been raised, and upright member 1 has been lowered. Warp thread 23 is below the shed opening 25, and warp thread 24 is above the shed opening. Weft thread 26, previously woven in the first leno position, is shown in cross-section, as is weft thread 27, which is in the shed opening created by the second leno position.

Alternation of the two leno positions (FIGS. 2 and 6) creates cross-weaving.

Figure 7:
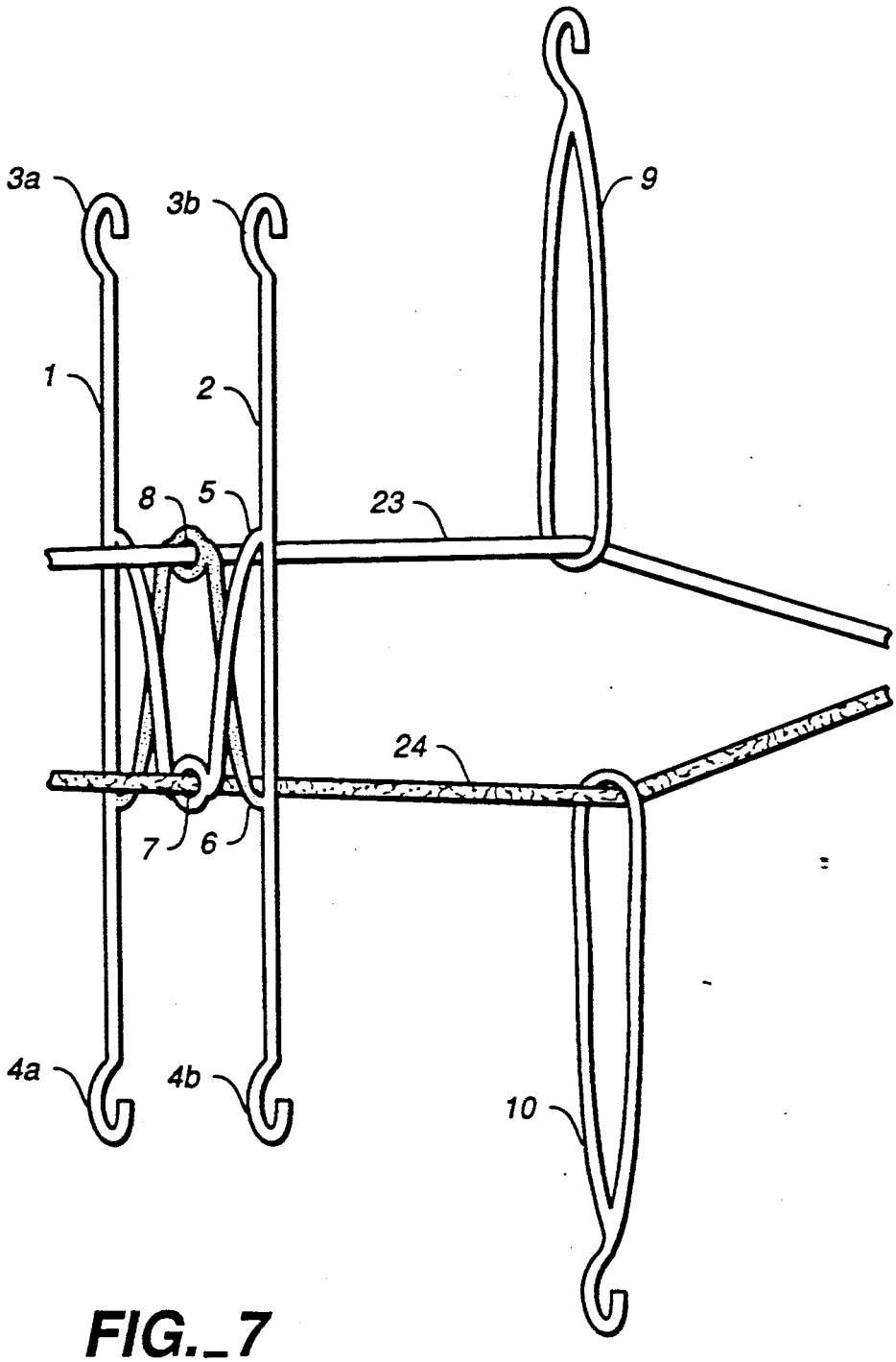
FIG. 7 is an oblique view of the leno heddle system of the present invention in operation in a tabby position.

For ordinary weaving, to create the tabby shed, both uprights are at the same elevation, as in FIG. 7, but the hanging tabby loop 9 is raised and/or the rising tabby loop 10 is lowered. If the tabby shed is opened alternately with the first leno shed (FIG. 2), ordinary weaving will be in the first tabby position, with warp thread 23 up and to the right of warp thread 24. If the tabby shed is opened alternately with the second leno shed (FIG. 6), warp thread 23 will be up and to the left of warp thread 24, and ordinary weaving in the second tabby poisition will result. If, however, one or several tabby sheds are used between the two leno positions, the warp thread 23 will cross over the throws of tabby weft. On the alternate face of the fabric, warp thread 24 will also cross over the tabby throws.

It is to be understood that the mechanical devices for raising and/or lowering the heddles and loops can be varied with the type of loom. used. However, for maximum efficiency of function, the leno heddles should conform to these dimensions: the distance from points 11 to 13 should equal the distance from points 13 to 15 which should equal the distance from points 15 to 17, from 12 to 14, from 14 to 16, from 16 to 18, from 13 to 20, from 14 to 19, from 15 to 22 and from 16 to 21.

The warp threads 23 and 24 move freely in this system. There is no ground or stationary warp and no jumper or leno warp. Therefore, both warp threads are consumed equally and there is no need for extra tensioning devices or a second warp beam. Further, as neither loops, heddles, nor members of the warp pair themselves interfere with the movement of the warp threads, there is none of the added friction and tension which can lead to fraying or breakage of warp threads. Thus, because good sheds can be easily formed in all four possible warp positions, this system allows the creation of a great variety of designs.

This discussion is intended to be illustrative and not limiting. It is also understood that this description is of a simple system and can be expanded to accommodate additional leno heddles and tabby loops for increased weave complexity and number of possible designs. The proper scope of this system is defined by the accompanying claims.

I claim:

1. A heddle system for cross-weaving, comprising:

(a) two spaced upright members;

(b) means for connecting the ends of said members to a loom frame; and (c) two cross-members located within the connecting means for connecting the upright members together, wherein each cross member has a generally centrally-located opening for passage of a warp thread there through.

2. The heddle system of claim 1, wherein the two cross members comprise:

(a) an upper rung assembly for connecting an upper portion of the first upright member to an upper portion of the second upright member; and (b) a lower rung assembly for connecting a lower portion of the first upright member to a lower portion of the second upright member.

3. The heddle system of claim 2, wherein the upper and lower rungs trisect each upright between the connections to the loom frame into sections of equal length, and wherein the length of each upright section defines the measure of each rung from its connection to the upright to the side of the opening opposite that upright.

4. The heddle system of claim 3, further comprising hanging and rising loops for ordinary weaving, wherein a first warp thread extends through the eye of the upper rung and through the rising loop, and wherein a second warp thread extends through the eye of the lower rung and through the hanging loop.

5. A method for cross-weaving on a heddle system having two upright members connected to a loom, an upper rung for connecting together the upper portions of each upright member, and a lower rung for connecting together the lower portions of each upright member, each rung having an eye therein, comprising the steps of:

(a) positioning the eye of the lower rung above the upper rung;

(b) inserting a first warp thread through the eye of the lower rung;

(c) positioning the eye of the upper rung below the lower rung;

(d) inserting a second warp thread through the eye of the upper rung;

(e) raising the first upright or lowering the second upright, or a combination of both to create a shed between the warp threads;

(f) throwing the weft through the shed;

(g) raising the second upright or lowering the first upright, or a combination of both;

(h) throwing the weft through the shed; and (i) repeating steps (e) through (h) as required by the pattern being cross-woven.

6. A method for ordinary weaving on a heddle system having two upright members connected to a loom, at least one hanging loop, at least one rising loop, an upper rung for connecting together the upper portions of each upright member, a lower rung for connecting together the lower portions of each upright member, each rung having an eye therein, wherein a first warp thread extends through eye of the upper rung, positioned below the lower rung, and the rising loop, and wherein a second warp thread extends through the eye of the lower rung, positioned above the upper rung, and the hanging loop, comprising the steps of:

(a) raising the hanging loop or lowering the rising loop, or a combination of both to create a shed between the warp threads;

(b) throwing the weft through the shed;

(c) raising the first upright or lowering the second upright, or a combination of both;

(d) throwing the weft through the shed; and (e) repeating steps (a) through (d) as required by the pattern being woven.

7. A method for ordinary weaving on a heddle system having two upright members connected to a loom, at least one hanging loop, at least one rising loop, an upper rung for connecting together the upper portions of each upright member, a lower rung for connecting together the lower portions of each upright member, each rung having an eye therein, wherein a first warp thread extends through the eye of the upper rung, positioned below the lower rung, and the rising loop, and wherein a second warp thread extends through the eye of the lower rung, positioned above the upper rung, and the hanging loop, comprising the steps of:

(a) raising the hanging loop or lowering the rising loop, or a combination of both to create a shed between the warp threads;

(b) throwing the weft through the shed;

(c) raising the second upright or lowering the first upright, or a combination of both;

(d) throwing the weft through the shed; and (e) repeating steps (a) through (d) as required by the pattern being woven.

* * * * *